US009056504B2

(12) United States Patent
Sauvage et al.

(10) Patent No.: US 9,056,504 B2
(45) Date of Patent: Jun. 16, 2015

(54) PAPER-ROLL LOADING DEVICE FOR A PRINTER OF A PAYMENT TERMINAL

(71) Applicant: Compagnie Industrielle et Financiere d'Ingenierie "Ingenico", Paris (FR)

(72) Inventors: Mickael Sauvage, Herblay (FR); Laurent Mayer, Courdimanche (FR); Caroline Wolff, Suresne (FR); Frank Robert, Paris (FR); Frederic Nguyen, Groslay (FR)

(73) Assignee: Compagnie Industrielle et Financiere d'Ingenierie "Ingenico", Paris (FR)

( * ) Notice: Subject to any disclaimer, the term of this patent is extended or adjusted under 35 U.S.C. 154(b) by 0 days.

(21) Appl. No.: 14/357,441

(22) PCT Filed: Nov. 13, 2012

(86) PCT No.: PCT/EP2012/072515

§ 371 (c)(1),
(2) Date: May 9, 2014

(87) PCT Pub. No.: WO2013/072317

PCT Pub. Date: May 23, 2013

(65) Prior Publication Data

US 2014/0320582 A1 Oct. 30, 2014

(30) Foreign Application Priority Data

Nov. 15, 2011 (FR) ..... 1160400
Feb. 15, 2012 (FR) ..... 1251374

(51) Int. Cl.

*B41J 11/00* (2006.01)
*B41J 15/04* (2006.01)
*B65H 16/06* (2006.01)

(52) U.S. Cl.

CPC ..... *B41J 15/042* (2013.01); *B65H 16/06* (2013.01); *B65H 2402/441* (2013.01); *B65H 2601/322* (2013.01)

(58) Field of Classification Search

USPC ..... 347/16, 171, 211, 213–215, 217–219; 400/611, 613, 618

See application file for complete search history.

(56) References Cited

U.S. PATENT DOCUMENTS

2007/0063086 A1 3/2007 Itoh et al.

FOREIGN PATENT DOCUMENTS

| | | | |
|---|---|---|---|
| JP | H1045285 | A | 2/1998 |
| JP | 2000335791 | A | 12/2000 |
| JP | 2008037659 | A | 2/2008 |
| WO | 2007111235 | A1 | 10/2007 |

OTHER PUBLICATIONS

International Search Report dated Jan. 22, 2013 for corresponding International Patent Application No. PCT/EP2012/072515, filed Nov. 13, 2012.

International Preliminary Report on Patentability and Written Opinion dated Jan. 30, 2014 for corresponding International Patent Application No. PCT/EP2012/072515, filed Nov. 13, 2012.

French Search Report dated Aug. 28, 2012 for corresponding French Patent Application No. 1251374, filed Feb. 15, 2012.

*Primary Examiner* — Kristal Feggins

(74) *Attorney, Agent, or Firm* — David D. Brush; Westman, Champlin & Koehler, P.A.

(57) ABSTRACT

A device is provided for loading a roll, including: a housing including a chamber defining an open cavity; and a roll support. The roll is rotatably mounted in the cavity.

8 Claims, 4 Drawing Sheets

PAPER-ROLL LOADING DEVICE FOR A PRINTER OF A PAYMENT TERMINAL

1. CROSS-REFERENCE TO RELATED APPLICATIONS

Figure 1:
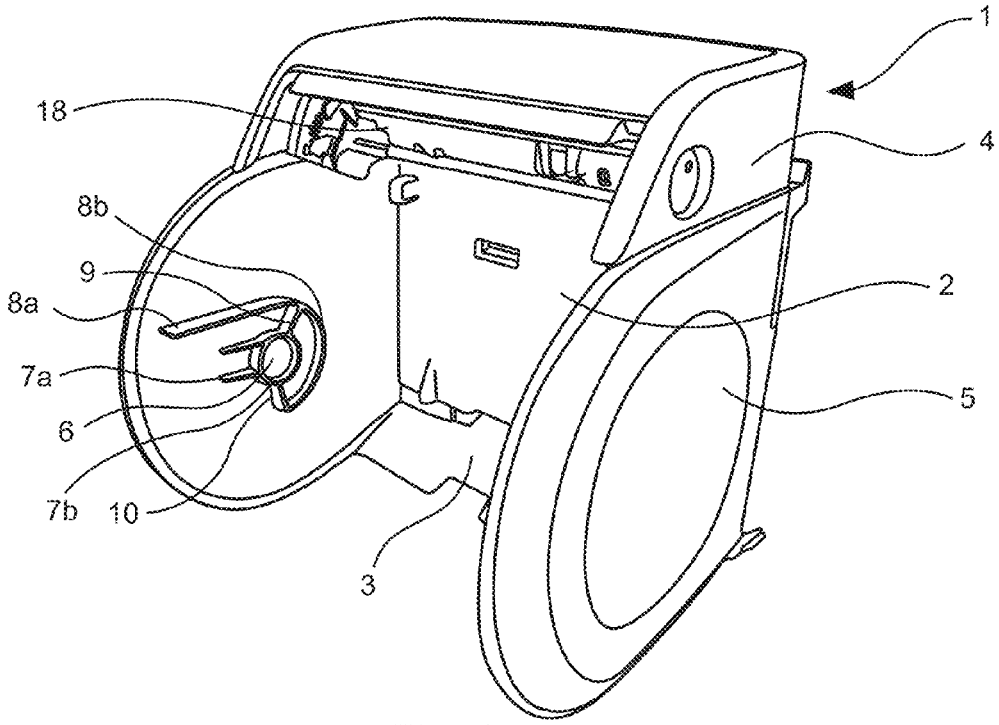

This Application is a Section 371 National Stage Application of International Application No. PCT/EP2012/072515, filed Nov. 13, 2012, which is incorporated by reference in its entirety and published as WO 2013/072317 on May 23, 2013, not in English.

2. TECHNICAL FIELD OF THE INVENTION

The field of the invention is that of enclosures for printing paper rolls that are to be positioned in thermal printers such as those used in fixed or mobile payment terminals.

In particular, the invention relates to a device suited for loading large-sized paper rolls while at the same time limiting the amount of space that could be required by this loading phase.

3. TECHNOLOGICAL BACKGROUND

The use of paper rolls for printers is well known. When the roll is empty or completed, it must be replaced. Different types of mechanisms are used to meet this need.

Thus, US 2011/0268488 describes a device for loading a paper roll into a printer that comprises a linking means supporting an access cover to open or close the housing of the paper roll. This device comprises inter alia a module for loading the paper roll constituted by two side panels to fix the axis of rotation of the paper roll when the access cover is closed. One of the panels can be pivoted towards a position in which, when the lid is open, an inclined guide surface is formed outside the device in order to guide the ejection of the used paper roll from the loading device. In other words, at least one part of the panel is exposed outside the loading device. Said device thus comprises a multitude of components joined with to each other according to mechanisms that are sometimes complex, resulting in numerous disadvantages such as major cost and production times, increased difficulty of use of the device, increased complexity of maintenance, increased fragility of the device and recycling difficulties.

Other less complex methods are used to overcome this difficulty.

Thus, WO 2008/042969 describes a paper towel dispenser comprising a cover and a housing connected to one another by a hinge which enables the cover to pivot between a closed position and an open position. This invention therefore proposes a mechanism to replace the paper roll easily.

However, the major drawback of the devices described here above comes from the large amount of space required during the phase of loading the paper roll. Indeed, the use of pivot links to join the roll-receiving case and the associated containing support require this support to be entirely deployed outside the case. The user is therefore obliged to release the space needed for the deployment of this support during the roll-loading phase.

4. SUMMARY OF THE INVENTION

These goals, as well as others that shall appear more clearly here below, are achieved by means of a device for loading a roll comprising:

- a case comprising an enclosure demarcating an open cavity,
- a roll support.

According to the invention, the roll support is mounted rotationally in said cavity.

Throughout the text, the term "roll support" designates a part to which this roll can be adapted by using or not using the joining means. The term "case" designates a solid or empty body surrounded by a finished external surface. The term "cavity" designates an unoccupied volume generated by a recess of this finished external surface. The term "enclosure" designates a portion of the finished external surface that demarcates this cavity.

A loading device according to the invention makes it possible to limit the amount of space that could be required by the phase for loading a roll. Indeed, the rotational linking of the support in the enclosure makes it possible, during this loading phase, to keep a part or the totality of the support inside the enclosure. There is therefore no shifting of the entire support outside the enclosure as in the case of pivot links linking the support and the enclosure in the prior art. In other words, the loading device as described by the invention is more compact, therefore enabling the user to move this device with greater ease and place it in smaller spaces.

According to one particular characteristic, the roll support is adapted to being shifted from a first position, called a loading position in which said roll can be mounted on said support, towards a second position, called a position of use, in which said support places said roll in said cavity.

Thus, the loading device enables the definition, independently of the user's judgment, of two positions of the support respectively corresponding to two modes of operation of the loading device and, by extension, modes of operation of the printer with which this device can be joined. This additional characteristic improves the stability of the loading device by reducing the errors linked to mishandling by the user. Furthermore, the device is also less complex to implement for the user who does not need use his personal judgment to evaluate the conformity of the position of the support with the mode of operation desired.

According to one particular characteristic, said support is adapted to concealing said cavity when said support in a position of use.

Thus, the roll support, when in a position of use, isolates the roll within the closed structure, constituted by the enclosure and this very same roll support. These additional characteristics first of all prevent any foreign body from penetrating the enclosure and coming into contact with the roll when it is in a position of use and is, therefore, liable to be put into a rotational motion. These unwanted foreign bodies can for example take the form of impurities present in the environment of the loading device that get housed, by means of the enclosure, in the mechanism of a printer, thus impairing this printer. The additional characteristics described here above also limit the risks of injury that could be caused to an external user who is near the loading device, or an infant who might try to stop the movement of the roll by curiosity, for example by putting his finger in the enclosure. The isolation of the roll between the enclosure and the support also limits the propagation of the noise generated by the motion of the roll while giving better protection to the device in the event of impact.

According to one particular characteristic, the loading device comprises means for joining said support with said case.

Thus, the means for joining the roll support with the case make it possible to check the position of these two elements relative to each other and therefore reduce the risks of error related to poor coordination in the space of these two elements. In particular, these joining means reduce the risks of accidental rejection of the support out of the enclosure.

According to one particular characteristic, the means for joining comprise a pin, called a rotation pin, cooperating with a rotation bearing.

Thus, a pin, in cooperating with the rotation bearing, facilitates and secures the rotational motion of the roll support relative to the case. Furthermore, a pin is a mechanical part of low complexity that is robust and can be machined at low cost. This is why it is clearly useful for reducing manufacturing costs, for the reliability of the joining means and therefore, by extension, for the stability of the loading device.

According to one particular characteristic, said support comprises at least one pin, called a guide pin, cooperating with guide rails, made in said enclosure, comprising at least one circular portion.

Thus, the roll support, by means of at least one guide pin, is guided around the axis defined by the rotation pin, thus reducing the stresses exerted on the rotation pin alone and thus improving the stability of the system. It is clear that a system in which the guide pin and the guide rails are respectively formed in the case and the roll support have the same advantages as those described here above. This observation is verified here below in the document.

According to one particular characteristic, the loading device is characterized in that, in addition to a circular portion, said guide rails comprise a rectilinear portion oriented towards the exterior of said enclosure.

Thus, a rectilinear portion oriented towards the exterior of the enclosure facilitates the insertion by the user of the roll support into the case in respectively guiding the guide pin and the rotation pin towards the circular part of the guide rails and the rotation bearing.

According to one particular characteristic, said support comprises at least one pin, called a rotational locking pin, cooperating with two stops formed transversally between said guide rails, each stop respectively demarcating the loading position and the position of use of said support.

Thus, the two stops formed transversally between the guide rails make it possible, mechanically and independently of the user's judgment, to tie down the roll support in the portion of the guide rails included between these same stops. This additional characteristic therefore provides the advantages specified here above and related to the taking, by the roll support, of two predefined positions. In addition, the machining of the stops between the guide rails costs little and is not complicated to implement. This means that the invention is obviously promising in terms of the reducing costs and manufacturing times.

According to one particular characteristic, said guide pin and said rotational locking pin are one and the same.

A device that comprises only one pin to provide the guide and rotational locking functions is technically less complex. This entails a reduction in manufacturing costs, an increase in service life and easier maintenance of the loading device.

According to one particular characteristic, at least one of said pins is mounted on a base made up of an elastic material.

Thus, when the user inserts the roll support into the case, the rotation pin and the rotationally locking pin respectively abut the edges of the rotation bearing and the stops formed transversally between the guide rails, countering the force exerted by the user with a resistance force.

When the base of a pin is formed by an elastic material, this material tends to get deformed under the effect of this resistance force and shifts the associated pin towards the interior of the roll support. This shifting has several effects:

- it enables a rotation pin to cooperate with the rotation bearing,
- it enables the rotational locking pins to surmount the pins formed transversally in the guide rails,
- it causes a thinning of the roll support, thus maintaining the roll in the support in compression without any need to resort to additional joining means,
- it reduces the stresses exerted by the user on the rest of the loading device.

According to one particular characteristic, said joining means are reversible, enabling the mounting and dismounting of the support in the case.

Thus, the reversibility of the joining means makes the roll support detachable from the case. This characteristic also facilitates the maintenance of the loading device.

According to one particular characteristic, said support comprises reversible locking means for the reversible locking of the support on the case in the position of use by means of a clip.

Thus, the use of a clip enables the securing, independently of the rest of the device, of the reversible locking of the support to the case in the position of use, giving rise to greater stability for the loading device.

5. LIST OF FIGURES

Figure 2:
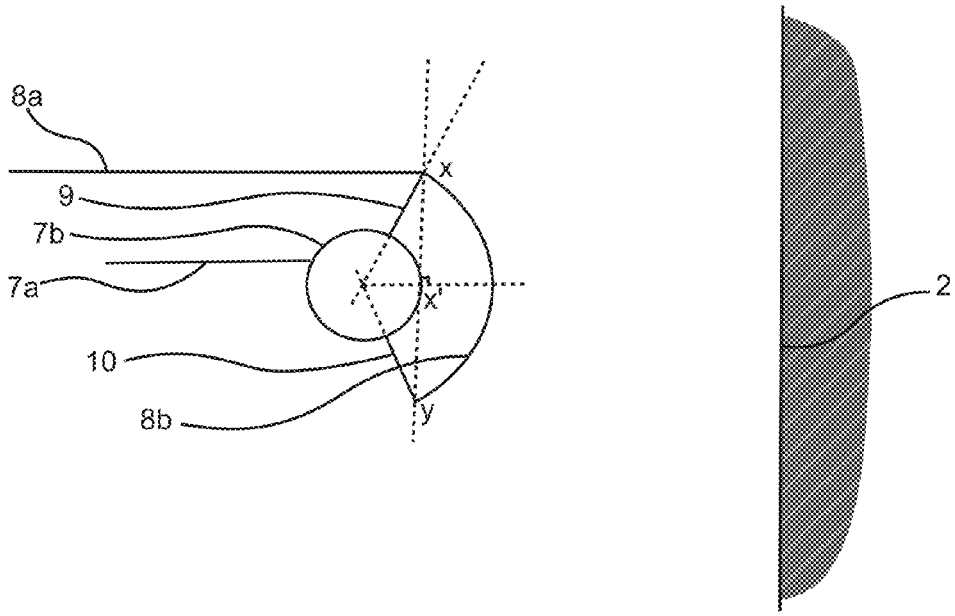
Figure 3:
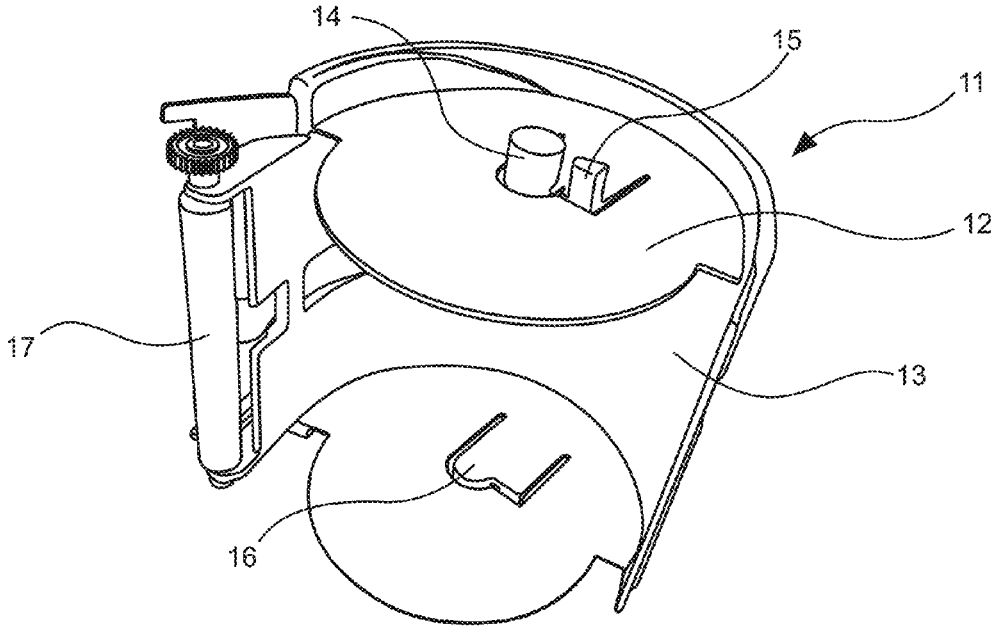
Figure 4:
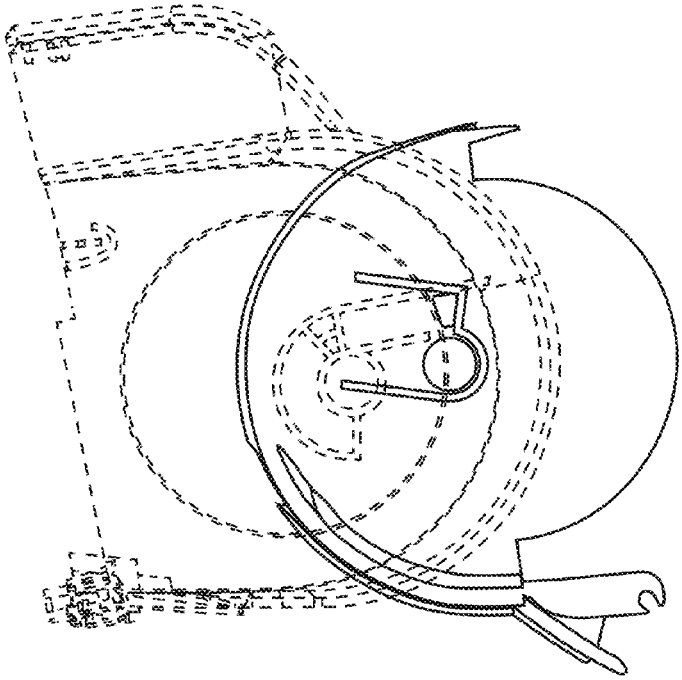
Figure 5:
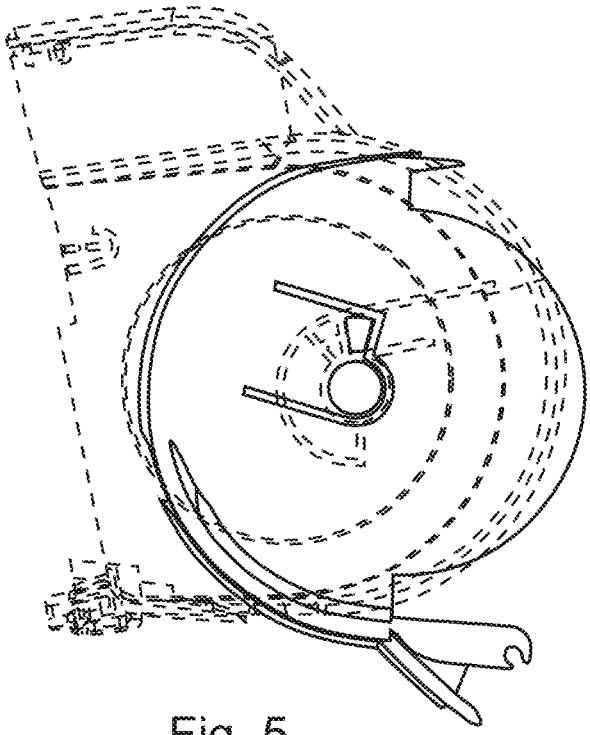
Figure 6:
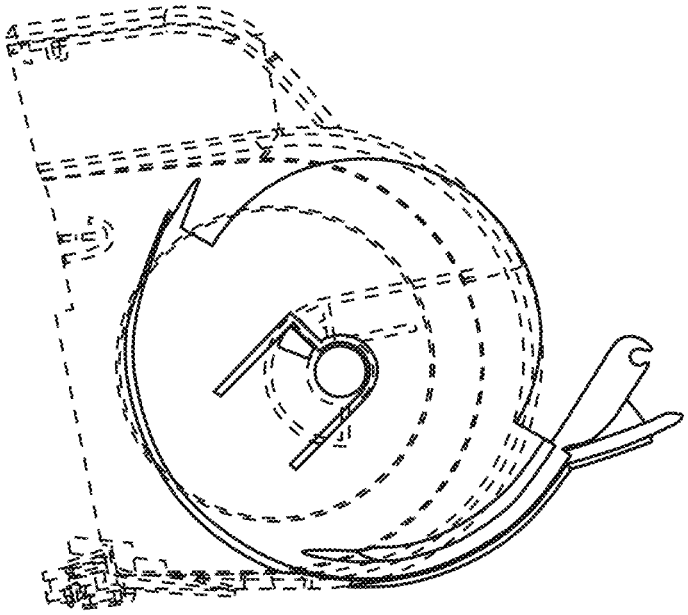
Figure 7:
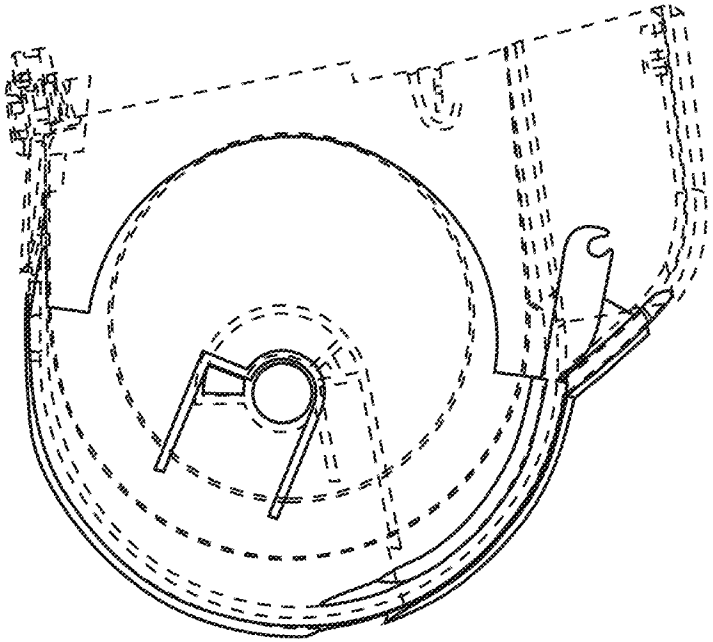

Other features and advantages of the invention shall appear from the following description given by way of a non-exhaustive example of one embodiment of the invention, with reference to the appended drawings. In these figures:

FIG. 1 is a schematic view in perspective of the case, isolated from the rest of the loading device, FIG. 2 is a schematic side view of the internal face of the side cheek of the case, FIG. 3 is a schematic view in perspective of the roll support isolated from the rest of the loading device, FIG. 4 is a side view in transparency of the loading device in an insertion phase, FIG. 5 is a side view in transparency of the loading device in the interlocking phase, FIG. 6 is a side view in transparency of the loading device in a loading phase, FIG. 7 is a side view in transparency of the loading device in a position of use.

6. DETAILED DESCRIPTION OF ONE EMBODIMENT OF THE INVENTION

In the figures, the scales and proportions are not strictly complied with, for purposes of illustration and clarity. Throughout the detailed description that follows with reference to the figures, unless otherwise stated, each element of the loading device is described as laid out when the seat of the case is mounted horizontally and when the rear face is mounted vertically. This layout is represented especially in FIGS. 1 and 3 to 6.

In FIG. 1, the case 1 has a plane rear face 2 mounted vertically on a horizontal seat 3 and surmounted in a linked position by an upper frame 4 with which the seat 3 is parallel. The case 1 also comprises two mutually parallel lateral cheeks 5 connected to the elements of the case 1 described here above so as to form a cavity. The lateral cheeks 5 are characterized by a disk shape and comprise a rotation bearing 6 mounted on the centre of the inner face of each of them.

According to another embodiment, the rear face 2 also comprises means for joining with an external printing system.

In FIG. 2, each of the side cheeks 5 comprises an internal guide rail 7 on its inner face. This guide rail 7 comprises a rectilinear portion 7*a* and a circular portion 7*b*. The circular portion 7*b* coincides with the rim of the rotation bearing 6. The rectilinear portion 7*a* is laid out in the extension of the circular portion 7*b* and is oriented externally to the cavity in a direction substantially orthogonal with the rear face 2.

Each of the side cheeks 5 also comprises an external guide rail 8 on its inner face. The external guide rail 8 is constituted by a rectilinear portion 8*a* and a circular portion 8*b*. The rectilinear part 8*a* surmounts the internal guide rail 7 with which it is substantially parallel and extends from a theoretical point x, towards the exterior of the cavity. This theoretical point x can be defined as the intersection between the rectilinear portion 8*a* of the external guide rail 8 and the theoretical tangent to the rotation bearing 6 along the side cheek 5 passing through the theoretical point x', the theoretical point x' being the distal end of the rotation bearing 6, included in the theoretical axis perpendicular to the rear face 2 of the case 1 and passing through the centre of the rotation bearing 6. In other words, the rectilinear portion 8*a* of the external guide rail 8 is appreciably perpendicular to the rear face 2 of the case 1. The rectilinear portion 8*a* and the circular portion 8*b* of the external guide rail 8 are linked to each other at the theoretical point x. The circular portion 8*b* of the external guide rail 8 extends rotationally around the centre of the rotation bearing 6 between the theoretical point x and a theoretical point y, the theoretical point y being symmetrical with x relative to x'.

Each of the side cheeks 5 also comprises an opening stop 9 which extends from the external guide rail 8 to the internal guide rail 7 along the axis linking the theoretical point x to the centre of the rotation bearing 6, as well as a closing stop 10 which extends from the external guide rail 8 to the internal guide rail 7 along the axis linking the theoretical point y to the centre of the rotation bearing 6. In other words, each of the stops is mounted transversally between the external guide rail 8 and the internal guide rail 7.

In FIG. 3, the roll support 11 is constituted by two mutually parallel, disk-shaped side panels 12, characterized by dimensions appreciably equivalent to those of the side cheeks 5 of the case 1, and at a distance from each other smaller than the distance between the two side cheeks 5, so as to be able to get housed between these side cheeks. A rectangular cover 13 mutually connects the respective distal parts of each of the side panels 12 along an angle substantially equal to 180° relative to the centre of each side panel 12 and in such a way that, when the case 1 and the roll support 11 are joined, the cover 13 can entirely conceal the cavity made in the case 1.

Each of the side panels 12 of the roll support 11 also comprises, at the centre of its external face, a pin called a rotation pin 14 which can get rotationally joined with a rotation bearing 6 of the case 1. A pin, called a guide pin 15, is also mounted on the external face of each of the side panels 12 in proximity to the rotation pin 14 so that it can cooperate with the guide rails 7 and 8 and get housed against the opening stop 9 and closing stop 10 when the rotation pin 14 is joined with the rotation bearing 6.

The entire loading device is manufactured, by an injection process, out of a plastic material because of its low production costs, its low density and its capacity for cold working. The choice of another material in the composition of the loading device however can be envisaged here below in the detailed description without any modification of the characteristics of the device, other than those intrinsic to the material that forms it.

The rotation pins 14 and the guide pins 15 are mounted on a base 16 partially cut out of the side panel 12 so that this base 16 is not linked to the rest of the side panel 12 except in one direction. This characteristic accentuates the lateral shifting of this base 16 in response to a force that can be exerted longitudinally on one of the pins.

A male clip 17 is positioned at one of the ends of the cover 13 so that it can cooperate with a female clip 18 positioned in the upper frame 4 of the case 1.

In the phase known as the insertion phase and as shown in FIG. 4, the roll support 11 is placed by the user in a configuration known as a loading configuration in which the cover 13 of the roll support 11 is oriented towards the interior of the cavity formed in the case 1 with the male clip 17 of the roll support 11 positioned appreciably in the plane defined by the seat 3. The roll support 11 is then shifted along a motion of translation towards the case 1 so that the guide pin 15 gets joined between the guide rails 7 and 8. The motion is continued by the user until the guide pin 15 and the rotation pin 14 respectively come into contact with the stop 9 and the rotation bearing 6, thus characterizing, by their position, the initial conformation of the device for the phase known as the coupling phase as shown in FIG. 5.

According to another embodiment, the guide rails 7 and 8 and the rotation bearing 6 can be formed in the external faces of at least one of the side panel 12 of the roll support 11 while the guide pin 15 and the rotation pin 14 are formed in the internal face of at least one of the side cheeks 5 of the case 1.

According to another embodiment, the female clip 18 is positioned in the seat 3 of the case and the rectilinear part 8*a* of the external guide rail 8 is positioned beneath the rotation bearing 6. When the roll support 11 is placed in a loading configuration, the male clip 17 of the roll support 11 is then positioned appreciably in the plane defined by the upper frame 4.

The coupling phase is divided into two stages, respectively corresponding to the joining of the rotation pin 14 with the rotation bearing 6 and the crossing of the opening stop 9 by the guide pin 15.

In a first stage, a compression force $F_c$ is exerted by the user on the roll support 11. The force $F_c$ is directed along an axis appreciably parallel to the theoretical axis perpendicular to the rear face 2 of the case 1 and is oriented towards the interior of the cavity formed by the case 1. The force $F_c$ is exerted on the rotation bearing 6 by means of the rotation pin 14 and gives rise to an elastic deformation of the rotation bearing 6 which is characterized by a tilting of the rim of this bearing towards the rear face 2 of the case 1. In another embodiment, the inclination of the contours of the rotation bearing 6 is the result of a geometry defined during the phase of manufacture of the loading device. In response to the force $F_c$, the rotation bearing 6 gives rise to a reaction force by the support, the tangential component of which causes a rectilinear shift of the rotation pin 14 towards the internal face of the side panel 12 on which it is mounted. This shift is facilitated by the use, in the composition of the bases of the pins, of an elastic material which has better capacity to get deformed than an ordinary material. Since the base of the rotation pin 14 is located appreciably at the centre of the side panels, the deformation of the internal face of the side panels 12, caused by the shifting of the pin, is the maximum at this location. When the centre of the roll is positioned at the centre of the internal face of the side panels 12, the roll is then held therein in rotation about the axis perpendicular to the side panels 12 and passing through the rotation bearing 6. Rolls of different sizes can therefore be positioned in the device without this characteristic affecting the position of the roll and more generally the working of the device.

The process ends when the shifting of the rotation pin 14 is sufficient to enable it to cross the rim of the rotation bearing 6 and to get joined with it.

In a second stage, a process similar to the one described for the joining of the rotation pin 14 with the rotation bearing 6, enables the guide pin 15 to cross the opening stop 9.

According to the embodiment described, the length of at least one of the pins is always greater than the distance between the side cheeks 5 of the case 1 and the side panels 12 of the roll support 11 so that the compression force of the side cheeks 5 on the pin makes it possible, throughout the different operating phases of the device, to maintain the roll in compression between the side cheeks 12.

According to this same embodiment, the technical characteristics of the pins, the rotation bearing 6 and the opening stop 9 are defined so that the force $F_c$ needed to carry out the coupling phase corresponds to a level of power that can be exerted by an adult user while at the same time offering resistance enabling the stability of the loading device to be reinforced.

According to another embodiment, the joining of the rotation pin 14 with the rotation bearing 6 and the crossing of the opening stop 9 by the guide pin 15 are done simultaneously. The value of the force $F_c$ needed to carry out the coupling phase is then greater than that needed according to the embodiment described.

According to another embodiment, the roll support 11 comprises no pin except on one of its side panels 12. This conformation however increases the risks of the roll support 11 being torn away from the case 1.

Following the coupling phase, the rotation pin 14 is joined with the rotation bearing 6 while the guide pin is joined between the internal guide rails 7*b* and 8*b* between the opening stop 9 and the closing stop 10 which respectively define the position known as the loading position and the position known as the position of use of the loading device.

When the roll support is shifted in the loading position as represented by FIG. 6, the opening of the roll support 11 on the exterior of the loading device is sufficient for a roll with a 62 mm diameter to be placed on this same support.

When the roll support 11 is shifted in the position of use, as represented by FIG. 7, the entire cavity formed inside the case 1 is concealed by this same support. The male clip 17 is then joined with a female clip 18 and reversibly locks the loading device in the position of use.

According to another embodiment, the loading device has no guide pin 15. The positions of opening and use of the loading device are then defined respectively by the conformation of seat 3 relative to the roll support 11 and by the conformation of the upper frame 4 relative to this same support. The stability of the loading device is however reduced, especially because of the risks of deterioration of the components of this device when these components placed in contact with each other.

To initialize the uncoupling phase, the roll support 11 is first of all placed in a loading position. According to a process similar to the one described for the coupling phase, a traction force $F_t$, directed in a direction substantially parallel to the compression force $F_c$ but oriented in the opposite sense, is exerted by the user with a purpose of separating the rotation pin 14 from the rotation pin 6 and enabling the guide pin 15 to cross the opening stop 9. The roll support 11 can then be dismantled from the case 1.

The invention proposes a novel approach in which the roll reception housing has guide elements, for example snail-shaped (having a portion in the form of an arc of a circle extended by a substantially rectilinear portion) for the mounting, kinematics and retention of the roll.

In particular, the invention also pertains to a paper roll printer comprising a housing to receive said roll characterized in that it comprises, on at least one of these side walls, guide elements capable of cooperating with complementary elements formed on said roll so as to guide this roll when it is being positioned in said housing and control the rotation of said roll.

The invention also pertains to the payment terminals equipped with such a printer.

The invention also pertains to the rolls for such a printer, characterized in that they comprise complementary elements, capable of cooperating with the guiding elements of said printer.

Such a roll can also include a portion forming a cover for closing the reception housing.

Finally, the invention pertains to a method for placing a paper roll in such a printer. This method can include especially the following steps implemented by means of said complementary elements:

- inserting said roll by translation;
- rotating said roll so as to place said roll in its nominal position.

This roll can be a large-diameter roll (60 mm for example but this is not a restrictive figure) and can be integrated into a limited volume and design. In order to ensure the solidity of the printer set, it is formed by two parts.

The use of such a snail-shaped system can especially fulfill the following functions:

- guidance during assembly;
- rotation of the roll support without an additional shaft to be inserted in the roll;
- optimal setting and control of the opening of the roll support.

Thus, the invention makes it possible simply and efficiently to integrate a printer with a big roll in a compact space. Indeed, it is almost a skin that is made around the roll.

The invention therefore proposes a mechanism enabling the mounting, kinematics and retention of these different roll formats in a compact space.

The mounting is simplified and requires no particular tooling. As specified here above, it is indeed not necessary to use additional tools or assembling systems. This therefore gives a gain in productivity. Using elastic lugs, the roll support can easily be dismantled, for example with a lever.

An embodiment of the invention provides a roll-loading device that is compact also during the roll-loading phase and is capable of integrating a large-sized roll.

An embodiment provides a loading device of little complexity in its implementation and not dependent on the user's judgment.

An embodiment provides a loading device that reduces the risks of deterioration of the device and of the printing system with which it can be joined or the inconvenience that can be caused in its direct environment.

An embodiment provides a loading device implementing mechanisms of low complexity that can be easily mounted in the factory or can be easily repaired.

An embodiment also provides detachable means for joining the support with the case.

An embodiment also provides a joining means to facilitate and guide the insertion of the support into the case.

An embodiment provides a secondary and independent joining means used to lock the device when it is in a phase of use.

Although the present disclosure has been described with reference to one or more examples, workers skilled in the art will recognize that changes may be made in form and detail without departing from the scope of the disclosure and/or the appended claims.

The invention claimed is:

1. A device for loading a roll comprising:

a case comprising an enclosure demarcating an open cavity and comprising a rotation bearing and at least one guide rail, made in said enclosure, the at least one guide rail comprising at least one circular portion;

a roll support, said roll support being mounted rotationally in said cavity and comprising at least one pin, called a guide pin, cooperating with the at least one guide rail and at least one pin, called a rotation pin, cooperating with the rotation bearing to join the support with the case;

wherein said at least one guide rail comprises, in addition to the at least one circular portion, a rectilinear portion oriented towards an exterior of said enclosure.

2. The device for loading according to claim 1, wherein the roll support is configured to being shifted from a first position, called a loading position in which said roll can be mounted on said support, towards a second position, called a position of use, in which said support positions said roll in said cavity.

3. The device for loading according to claim 2, wherein said support is configured to conceal said cavity when said support is in the position of use.

4. The device for loading according to claim 1, wherein said at least one guide rail comprises a plurality of guide rails and said support comprises at least one pin, called a rotational locking pin, cooperating with two stops formed transversally between said guide rails, each stop respectively demarcating a loading position and a position of use of said support.

5. The device for loading according to claim 4, wherein said guide pin and said rotational locking pin are one and the same.

6. The device for loading according to claim 1, wherein at least one of said at least one rotation pin is mounted on a base made of an elastic material.

7. The device for loading according to claim 1, wherein the at least one rotation pin forms a means for joining the support and the case, which are reversible, enabling mounting and dismounting of the support in the case.

8. The device for loading according to claim 2, wherein said support comprises a clip that reversibly locks the support on the case in the position of use.

* * * * *